US009945591B2

(12) United States Patent
Mukherjee et al.

(10) Patent No.: US 9,945,591 B2
(45) Date of Patent: Apr. 17, 2018

(54) COOLING SYSTEM WITH INTEGRATED SUBCOOLING

(71) Applicant: Heatcraft Refrigeration Products LLC, Stone Mountain, GA (US)

(72) Inventors: Arijit Mukherjee, Kalyani (IN); Om Usturge, Vaibhav Nagar (IN)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 88 days.

(21) Appl. No.: 15/083,506

(22) Filed: Mar. 29, 2016

(65) Prior Publication Data

US 2017/0284715 A1 Oct. 5, 2017

(51) Int. Cl.

| | |
|---|---|
| ***F25B 1/10*** | (2006.01) |
| ***F25B 40/02*** | (2006.01) |
| ***F25B 5/02*** | (2006.01) |
| ***F25B 41/06*** | (2006.01) |
| ***F25B 43/00*** | (2006.01) |
| ***F25B 40/00*** | (2006.01) |
| *F25B 9/00* | (2006.01) |

(52) U.S. Cl.

CPC ..... *F25B 40/02* (2013.01); *F25B 1/10* (2013.01); *F25B 5/02* (2013.01); *F25B 40/00* (2013.01); *F25B 41/062* (2013.01); *F25B 43/006* (2013.01); *F25B 9/008* (2013.01); *F25B 2339/0242* (2013.01); *F25B 2341/0661* (2013.01); *F25B 2341/0662* (2013.01); *F25B 2400/051* (2013.01); *F25B 2400/13* (2013.01); *F25B 2500/18* (2013.01)

(58) Field of Classification Search

CPC ..... F25B 40/02; F25B 5/02

USPC ..... 62/498, 510

See application file for complete search history.

(56) References Cited

U.S. PATENT DOCUMENTS 2,116,100 A 5/1938 Cracknell
2,316,729 A * 4/1943 Tryon ..... B64D 37/22 137/544

(Continued)

FOREIGN PATENT DOCUMENTS

| | | |
|---|---|---|
| DE | 1101457 | 3/1961 |
| WO | WO 2008/019689 A3 | 2/2008 |
| WO | WO 2014/100330 A1 | 6/2014 |

OTHER PUBLICATIONS

EP Extended European Search Report for Application No. 17163149.2-1602, dated Jun. 19, 2017.

*Primary Examiner* — Melvin Jones
(74) *Attorney, Agent, or Firm* — Baker Botts L.L.P.

(57) ABSTRACT

A system includes a high side heat exchanger, a flash tank, a vessel, a load, and a compressor. The high side heat exchanger removes heat from a refrigerant. The flash tank stores the refrigerant from the high side heat exchanger. The vessel includes a chamber defined by an exterior housing and a tube positioned within the chamber. Heat is removed from the liquid refrigerant circulating through this tube and coming from the flash tank. The load uses the refrigerant from the tube to remove heat from a space proximate the load. The load sends the refrigerant into the chamber between the exterior housing and the tube. The compressor receives the refrigerant from the chamber between the exterior housing and the tube and compresses the refrigerant.

15 Claims, 3 Drawing Sheets

(56) References Cited

U.S. PATENT DOCUMENTS

| | | | | |
|---|---|---|---|---|
| 5,692,389 | A * | 12/1997 | Lord | F25B 5/02 62/218 |
| 6,463,757 | B1 * | 10/2002 | Dickson | F25B 40/00 29/890.06 |
| 2010/0223938 | A1 * | 9/2010 | Bush | F25B 1/10 62/117 |

* cited by examiner

COOLING SYSTEM WITH INTEGRATED SUBCOOLING

TECHNICAL FIELD

This disclosure relates generally to a cooling system, specifically a cooling system with integrated subcooling.

BACKGROUND

Cooling systems may be configured in a carbon dioxide booster system. This system may cycle $CO_2$ refrigerant to cool a space. The refrigerant may be cycled through a low temperature load, low temperature compressor(s), a medium temperature load, and medium temperature compressor(s). The system may also include a subcooler and an accumulator. The subcooler further cools the liquid refrigerant and the accumulator prevents the flow of any liquid refrigerant from load(s) into the compressor(s).

SUMMARY OF THE DISCLOSURE

According to one embodiment, a system includes a high side heat exchanger, a flash tank, a vessel, a load, and a compressor. The high side heat exchanger removes heat from a refrigerant. The flash tank stores the refrigerant from the high side heat exchanger. The vessel includes a chamber defined by an exterior housing and a tube positioned within the chamber. Heat is removed from the liquid refrigerant circulating through this tube and coming from the flash tank. The load uses the refrigerant from the tube to remove heat from a space proximate the load. The load sends the refrigerant into the chamber between the exterior housing and the tube of the same vessel. The compressor receives the refrigerant from the chamber between the exterior housing and the tube and compresses the refrigerant.

According to another embodiment, a method includes removing heat from a refrigerant using a high side heat exchanger and storing the refrigerant using a flash tank. The method also includes sending the refrigerant from the flash tank to a tube of a vessel. The tube removes heat from the refrigerant. The vessel includes a chamber defined by an exterior housing. The tube is positioned within the chamber. The method also includes using the refrigerant to remove heat from a space proximate a load and sending the refrigerant from the load into the chamber between the exterior housing and the tube. The method further includes sending the refrigerant from the chamber between the exterior housing and the tube to a compressor. The compressor compresses the refrigerant.

According to yet another embodiment, a system includes a vessel, a load, and a compressor. The vessel includes a chamber defined by an exterior housing and a tube positioned within the chamber. The tube removes heat from a refrigerant from a flash tank. The load uses the refrigerant from the tube to remove heat from a space proximate the load. The load sends the refrigerant into the chamber between the exterior housing and the tube. The compressor receives the refrigerant from the chamber between the exterior housing and the tube and compresses the refrigerant.

Certain embodiments may provide one or more technical advantages. For example, an embodiment increases the amount of space available on a cooling system rack by integrating a subcooler and an accumulator into a single vessel. As another example, an embodiment decreases the pressure drop in the cooling system by integrating a subcooler and an accumulator into a single vessel and increasing the system efficiency. Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

Figure 1:
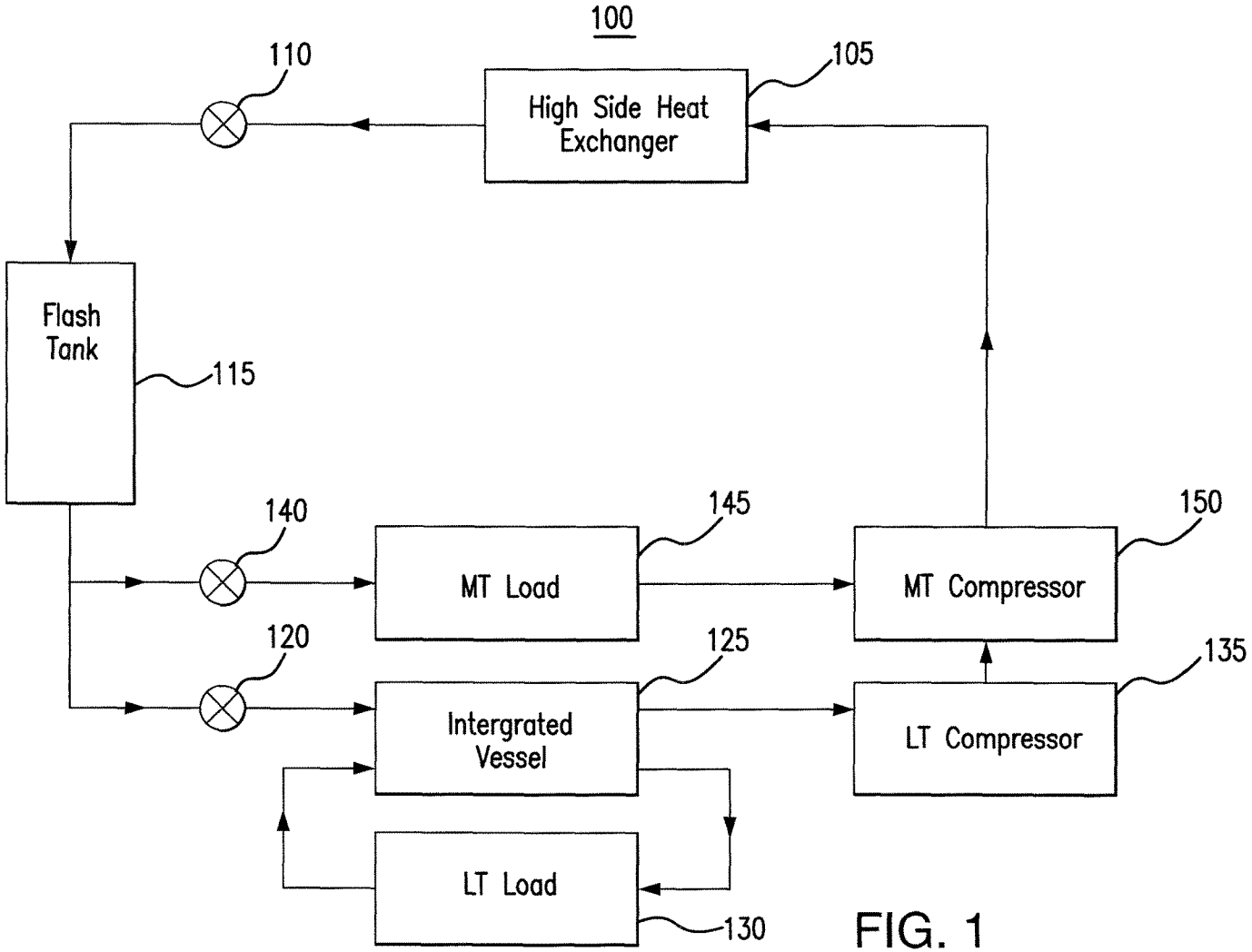
FIG. 1 illustrates an example cooling system.
Figure 2:
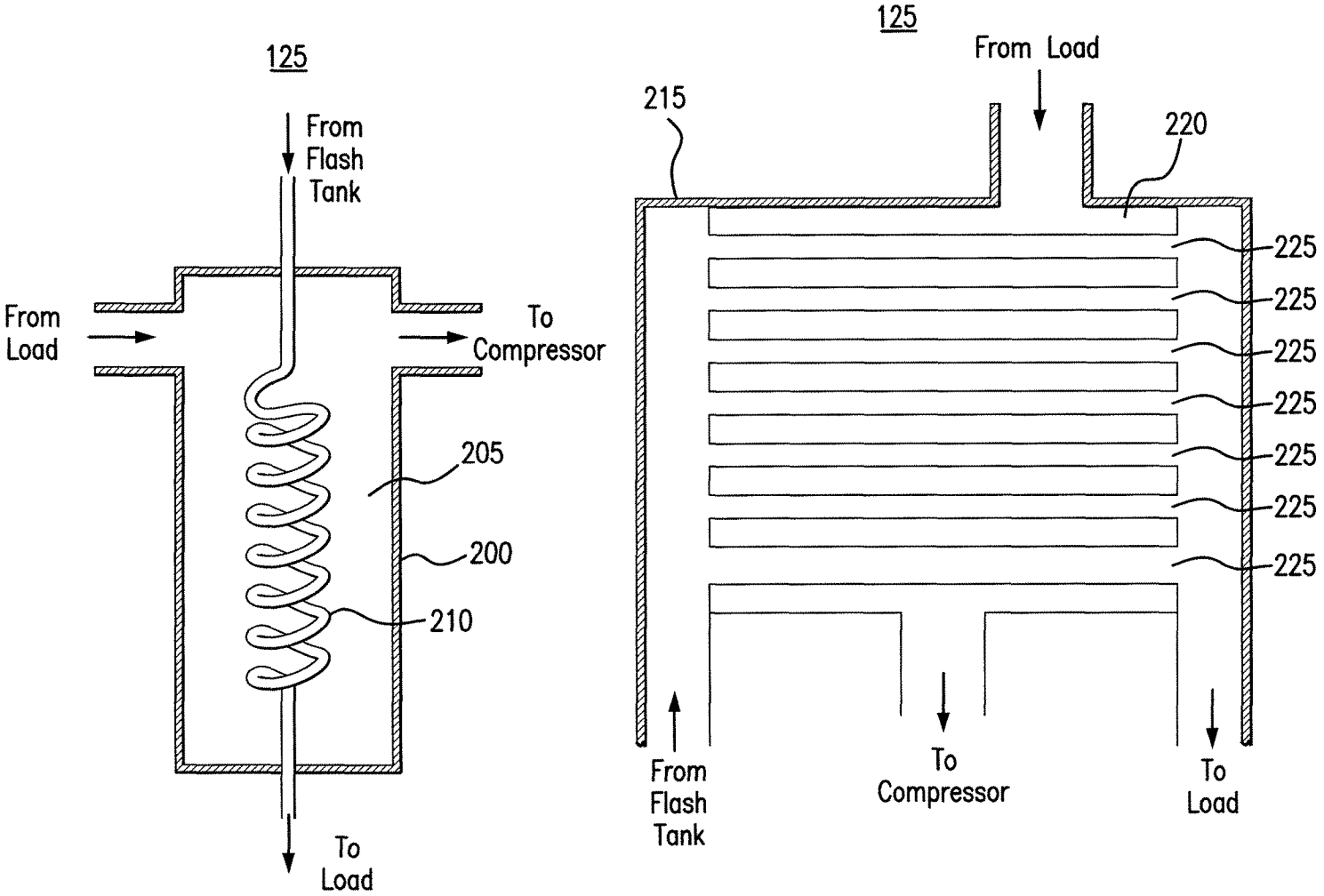
FIG. 2 illustrates various example vessels of the cooling system of FIG. 1.
Figure 3:
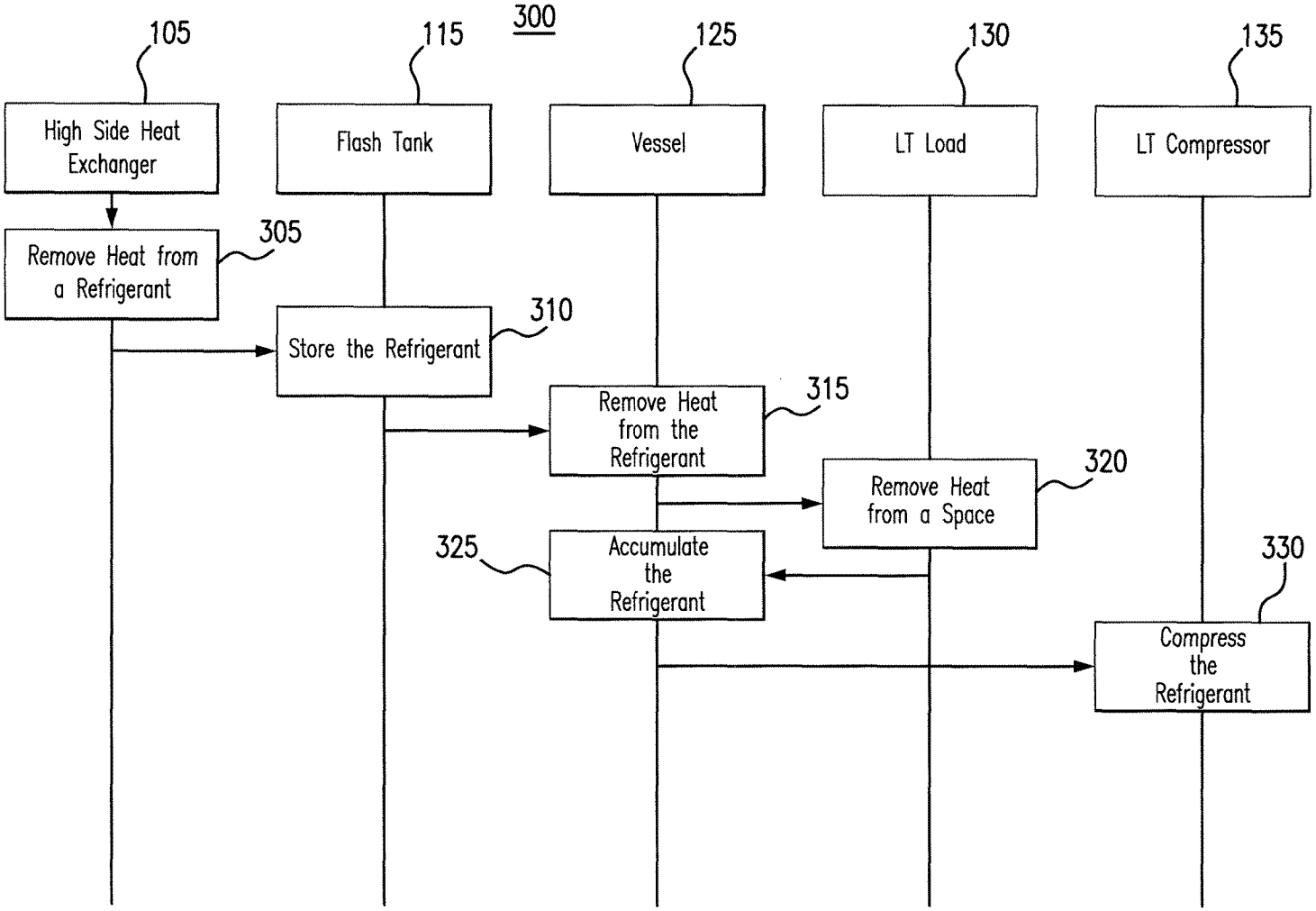
FIG. 3 is a flowchart illustrating a method of operating the example cooling system of FIG. 1.

Embodiments of the present disclosure and its advantages are best understood by referring to FIGS. 1 through 3 of the drawings, like numerals being used for like and corresponding parts of the various drawings.

Cooling systems, such as for example refrigeration systems, use a refrigerant to remove heat from a space. These systems may cycle refrigerant through low temperature loads and medium temperature loads to cool spaces corresponding to those loads. For example, in a grocery store, the low temperature loads may be freezers used to store frozen foods and the medium temperature loads may be refrigerated shelves used to store fresh produce. The refrigerant from the low temperature load is sent through low temperature compressors, and then that compressed refrigerant is mixed with refrigerant from the medium temperature load and refrigerant from the flash tank. That mixture is then sent through medium temperature compressors and then cycled back to a high side heat exchanger.

Many cooling systems include a subcooler before the loads. The subcooler further cools the refrigerant before sending the refrigerant to the loads. In this manner, the loads are able to efficiently cool a space to lower temperatures. For example, cooler refrigerant may help a freezer keep a space at the appropriate temperature for frozen foods. Many cooling systems also include an accumulator between the loads and the compressors. The accumulator operates to prevent liquid refrigerant from flowing into the compressors. When liquid refrigerant flows into compressors, it may cause the compressors to break down and malfunction. Therefore, by using the accumulator, the lifespan of the compressors may be increased.

Using both a subcooler and an accumulator introduces certain issues into the cooling system. For example, by including both a subcooler and an accumulator in the cooling system, more space on the cooling system rack is consumed. As a result, there is less space on the rack for other components of the cooling system. As another example, by using both the subcooler and the accumulator, the pressure drop across the cooling system is increased. As a result, the compressors in the cooling system use more energy to compress refrigerant up to a specified pressure for a high side heat exchanger.

This disclosure contemplates a cooling system with an integrated subcooler and accumulator. The integrated vessel includes an exterior housing that defines a chamber. A tube is positioned within the chamber. The tube acts as a heat exchanger that subcools refrigerant. After the refrigerant is used by the loads, the refrigerant is sent back through the chamber of the vessel before being sent to the compressors. As the refrigerant passes through the vessel, any liquid refrigerant precipitates by gravity at the bottom of the vessel. As a result, liquid refrigerant is not passed to the compressors. In particular embodiments, by integrating the subcooler and the accumulator in a single vessel the amount of available space on the cooling system rack is increased. Furthermore, by integrating the subcooler and the accumulator, the pressure drop across the cooling system is reduced. The cooling system will be described in more detail using FIGS. 1 through 3. FIG. 1 shows the cooling system generally. FIG. 2 shows various examples of the integrated vessel. FIG. 3 shows a method of operating the example cooling system.

This disclosure uses an example cooling system configured in a booster configuration with low and medium temperature loads and compressors. However, this disclosure contemplates using any appropriate cooling system configured in any appropriate manner. For example, this disclosure contemplates using an air conditioning system or a refrigeration system with no flash tank and only one type of load and compressor. Furthermore, this disclosure contemplates the system including one or more of any component used in the example cooling system.

FIG. 1 illustrates an example cooling system 100. As illustrated in FIG. 1, cooling system 100 includes a high side heat exchanger 105, expansion valve 110, flash tank 115, expansion valve 120, integrated vessel 125, low temperature load 130, low temperature compressor 135, expansion valve 140, medium temperature load 145, and medium temperature compressor 150. Integrated vessel 125 integrates a subcooler and an accumulator into one vessel. In particular embodiments, by using integrated vessel 125 the amount of space available on a rack for cooling system 100 is increased. Furthermore, the pressure drop across cooling system 100 is reduced.

High side heat exchanger 105 removes heat from a refrigerant. When heat is removed from the refrigerant, the refrigerant is cooled. This disclosure contemplates high side heat exchanger 105 being operated as a condenser and/or a gas cooler. When operating as a condenser, high side heat exchanger 105 cools the refrigerant such that the state of the refrigerant changes from a superheated gas to a liquid or from a superheated gas to a cooled gas. When operating as a gas cooler, high side heat exchanger 105 cools the refrigerant but the refrigerant remains a gas. In certain configurations, high side heat exchanger 105 is positioned such that heat removed from the refrigerant may be discharged into the air. For example, high side heat exchanger 105 may be positioned on a rooftop so that heat removed from the refrigerant may be discharged into the air. As another example, high side heat exchanger 105 may be positioned external to a building and/or on the side of a building.

Expansion valves 110, 120, and 140 reduce the pressure and therefore the temperature of the refrigerant. Expansion valves 110, 120, and 140 reduce pressure from the refrigerant flowing into the expansion valves 110, 120, and 140. The temperature of the refrigerant may then drop as pressure is reduced. As a result, warm or hot refrigerant entering expansion valves 110, 120, and 140 is cooler when leaving expansion valves 110, 120, and 140. The refrigerant leaving expansion valve 110 is fed into flash tank 115. Expansion valves 120 and 140 feed low temperature load 125 and medium temperature load 135 respectively.

Flash tank 115 stores refrigerant received from high side heat exchanger 105 through expansion valve 110. This disclosure contemplates flash tank 115 storing refrigerant in any state such as, for example, a liquid state and/or a gaseous state. Refrigerant leaving flash tank 115 is fed to low temperature load 125 and medium temperature load 135 through expansion valves 120 and 140.

System 100 includes a low temperature portion and a medium temperature portion. The low temperature portion may operate at a lower temperature than the medium temperature portion. In some refrigeration systems, the low temperature portion may be a freezer system and the medium temperature system may be a regular refrigeration system. In a grocery store setting, the low temperature portion may include freezers used to hold frozen foods and the medium temperature portion may include refrigerated shelves used to hold produce. Refrigerant may flow from flash tank 115 to both the low temperature and medium temperature portions of the refrigeration system. For example, the refrigerant may flow to low temperature load 130 and medium temperature load 145. When the refrigerant reaches low temperature load 130 or medium temperature load 145, the refrigerant removes heat from the air around low temperature load 130 or medium temperature load 145. As a result, the air is cooled. The cooled air may then be circulated such as, for example, by a fan to cool a space such as, for example, a freezer and/or a refrigerated shelf. As refrigerant passes through low temperature load 130 and medium temperature load 145 the refrigerant may change from a liquid state to a gaseous state.

Refrigerant flows from low temperature load 130 and medium temperature load 145 to compressors 135 and 150. This disclosure contemplates system 100 including any number of low temperature compressors 135 and medium temperature compressors 150. Both low temperature compressor 135 and medium temperature compressor 150 increase the pressure of the refrigerant. As a result, the heat in the refrigerant becomes concentrated and the refrigerant becomes a high pressure gas. Low temperature compressor 135 compresses refrigerant from low temperature load 130 and sends the compressed refrigerant to medium temperature compressor 150. Medium temperature compressor 150 compresses refrigerant from low temperature compressor 135 and medium temperature load 145. Medium temperature compressor 150 then sends the compressed refrigerant to high side heat exchanger 105.

Many cooling systems include a subcooler between flash tank 115 and low temperature load 130. The subcooler removes heat from the liquid refrigerant stored in flash tank 115 before that refrigerant is used by low temperature load 130. By cooling the refrigerant, the subcooler prepares the refrigerant for use by low temperature load 130. When low temperature load 130 uses a cooler refrigerant, low temperature load 130 better cools a space proximate low temperature load 130. Many cooling systems also include an accumulator between low temperature load 130 and low temperature compressor 135. The accumulator operates to prevent liquid refrigerant from flowing into low temperature compressor 135. When liquid refrigerant enters low temperature compressor 135 the liquid refrigerant damages low temperature compressor 135 and may cause low temperature compressor 135 to malfunction or break down. Therefore, the accumulator improves the lifespan of low temperature compressor 135.

When the subcooler and the accumulator are both used in cooling system 100 as separate vessels, the amount of available space on a rack for cooling system 100 decreases. Furthermore, by separating the subcooler and the accumulator the pressure drop across cooling system 100 increases.

As a result of the pressure drop, low temperature compressor 135 and medium temperature compressor 150 work more to compress the refrigerant to an appropriate pressure for high side heat exchanger 105.

Integrated vessel 125 integrates a subcooler and an accumulator into a single vessel. In particular embodiments, integrated vessel 125 includes an exterior housing that defines a chamber and a tube positioned within the chamber. The tube receives refrigerant from flash tank 115 and removes heat from the refrigerant before the refrigerant is sent to low temperature load 130. As a result, integrated vessel 125 acts as a subcooler by removing heat from the flash tank 115. After the refrigerant is used by low temperature load 130 to cool a space, low temperature load 130 sends the refrigerant back to integrated vessel 125. The refrigerant passes through the chamber of integrated vessel 125 between the exterior housing and the tube before being sent to low temperature compressor 135. As the refrigerant passes through integrated vessel 125, any liquid in the refrigerant precipitates by gravity at the bottom of the chamber or may also vaporize by absorbing heat from the tube(s) inside vessel 125. As a result, liquid refrigerant is converted into gaseous refrigerant before the refrigerant is sent to low temperature compressor 135. Therefore, integrated vessel 125 also operates as an accumulator.

As discussed previously, this disclosure contemplates using integrated vessel 125 in any appropriate cooling system. For example, this disclosure contemplates using integrated vessel 125 in an air conditioning system or refrigeration system, which does not include flash tank 115 and/or a medium temperature portion and a low temperature portion. Rather, the air conditioning system may include only one portion with a load and a compressor. Furthermore, this disclosure contemplates incorporating multiple integrated vessels 125 in system 100. For example, a second integrated vessel may be included between flash tank 115 and medium temperature load 145. The second integrated vessel subcools refrigerant before it reaches medium temperature load 145 and accumulates refrigerant before the refrigerant reaches medium temperature compressor 150.

In particular embodiments, cooling system 100 includes an accumulator between medium temperature load 145 and medium temperature compressor 150. The accumulator prevents the flow of liquid refrigerant into medium temperature compressor 150. Medium temperature load 145 sends refrigerant to medium compressor 150 through the accumulator. In some embodiments, low temperature compressor 135 sends refrigerant to medium temperature compressor 150 through the accumulator.

In particular embodiments, by using integrated vessel 125 the amount of available space on a rack for cooling system 100 is increased. Furthermore, the pressure drop across cooling system 100 is reduced because the subcooler and accumulator are integrated into a single vessel. As a result, the lifespan of low temperature compressor 135 is improved. Integrated vessel 125 will be described in more detail using FIG. 2. A method of operating cooling system 100 will be described using FIG. 3.

FIG. 2 illustrates various example vessels 125 of the cooling system 100 of FIG. 1. As illustrated in FIG. 2, vessels 125 may be configured in several different ways. This disclosure contemplates vessel 125 being configured in any appropriate manner to perform the functions of a subcooler and an accumulator.

The first example of vessel 125 includes an exterior housing 200, a chamber 205, and a tube 210. Exterior housing 200 serves to contain the components of vessel 125 and a refrigerant. Exterior vessel 200 also defines chamber 205. This disclosure contemplates exterior housing 200 being made from any appropriate material such as a metal.

Chamber 205 allows for the components of vessel 125 to be positioned within chamber 205. Furthermore, chamber 205 allows for refrigerant to flow through chamber 205. Chamber 205 may be a cavity within vessel 125 defined by exterior housing 200. For example, chamber 205 may be the entire space enclosed by exterior housing 200.

Tube 210 is positioned within vessel 125. For example, tube 210 is positioned within exterior housing 200. Tube 210 allows refrigerant to flow through tube 210. In particular embodiments, tube 210 operates as a heat exchanger. For example, tube 210 removes heat from refrigerant flowing through tube 210. Refrigerant flows through tube 210 from a flash tank to a load. As a result, tube 210 further cools the refrigerant from the flash tank before it is used by the load. As a result, tube 210 operates as a subcooler.

After the load uses the refrigerant from tube 210 to cool a space proximate the load, the load sends the refrigerant back to vessel 125. The refrigerant passes through chamber 205 between exterior housing 200 and tube 210 on its way to a compressor. As the refrigerant passes through chamber 205, any liquid refrigerant precipitates by gravity at the bottom of chamber 205. As a result, liquid refrigerant is prevented from flowing into the compressor. Therefore, vessel 125 also operates as an accumulator.

In particular embodiments, heat that is removed from the refrigerant in tube 210 is used to evaporate liquid refrigerant that has precipitated by gravity at the bottom of chamber 205. When that liquid refrigerant evaporates, the gaseous refrigerant is allowed to flow to the compressor. In this manner, the liquid refrigerant that precipitated by gravity at the bottom of chamber 205 will not overflow into the compressor.

This disclosure contemplates vessel 125 including any number of tubes. In the second example of vessel 125, vessel 125 includes an exterior housing 215, a chamber 220, and a plurality of tubes 225. As shown in FIG. 2, a cross-section of vessel 125 is presented in the second example. Exterior housing 215 defines chamber 220, which surrounds tubes 225. Similar to the first example, refrigerant from the load flows through chamber 220 on its way to the compressor. Any liquid refrigerant precipitates by gravity at the bottom of chamber 220. There is sufficient space at the bottom of chamber 220 to hold the liquid refrigerant. As a result, liquid refrigerant is prevented from flowing into the low temperature compressor.

The plurality of tubes 225 serve to remove heat from the refrigerant from the flash tank before it is used by the load. As the refrigerant flows through each of tubes 225, heat is removed from the refrigerant. As a result, the load receives a cooler refrigerant, which allows the load to more efficiently cool the space. After the load uses the refrigerant, the load sends the refrigerant back to vessel 125. Similar to the first example of vessel 125, refrigerant does not flow out of tubes 225 into chamber 220. Rather, tubes 225 are contained within chamber 220 and refrigerant from the flash tank flows through tubes 225 while refrigerant from the load flows through chamber 220 between exterior housing 215 and tubes 225.

In particular embodiments, by using vessel 125, the amount of available space on a rack for a cooling system 100 is increased because the subcooler and accumulator are combined into one vessel. Furthermore, by combining the subcooler and accumulator into one vessel the amount of pressure drop across system 100 is reduced.

FIG. 3 is a flowchart illustrating a method 300 of operating the example cooling system 100 of FIG. 1. In particular embodiments, various components of cooling system 100 perform the steps of method 300.

In step 305, high side heat exchanger 105 removes heat from a refrigerant. High side heat exchanger 105 then sends the refrigerant to flash tank 115. In step 310, flash tank 115 stores the refrigerant. Then, flash tank 115 sends the refrigerant to vessel 125.

In step 315, vessel 125 removes heat from the refrigerant, which cools the refrigerant. Then, vessel 125 sends the refrigerant to low temperature load 130. In step 320, low temperature load 130 removes heat from a space using the refrigerant. Then, low temperature load 130 sends the refrigerant back to vessel 125. In step 325, vessel 125 accumulates the refrigerant, which removes liquid refrigerant and prevents the liquid refrigerant from flowing into a compressor. Then, vessel 125 sends the refrigerant to low temperature compressor 135. In step 330, low temperature compressor 135 compressed the refrigerant.

In this manner, vessel 125 acts as both a subcooler and an accumulator. Vessel 125 acts as a subcooler by removing heat from the refrigerant in step 315. Furthermore, vessel 125 acts as an accumulator by accumulating the refrigerant in step 325. For example, liquid refrigerant may precipitate by gravity at the bottom of vessel 125 thereby preventing the liquid refrigerant from flowing into low temperature compressor 135. As a result, the lifespan of low temperature compressor 135 is improved.

Modifications, additions, or omissions may be made to method 300 depicted in FIG. 3. Method 300 may include more, fewer, or other steps. For example, steps may be performed in parallel or in any suitable order. While discussed as various components of cooling system 100 performing the steps, any suitable component or combination of components of system 100 may perform one or more steps of the method.

Although the present disclosure includes several embodiments, a myriad of changes, variations, alterations, transformations, and modifications may be suggested to one skilled in the art, and it is intended that the present disclosure encompass such changes, variations, alterations, transformations, and modifications as fall within the scope of the appended claims.

What is claimed is:

1. A cooling system comprising:
- a high side heat exchanger configured to remove heat from a refrigerant;
- a flash tank configured to store the refrigerant from the high side heat exchanger;
- a vessel comprising:
  - a chamber defined by an exterior housing; and
  - a tube positioned within the chamber, wherein heat is removed from the refrigerant from the flash tank and in the tube;
- a load configured to use the refrigerant from the tube to remove heat from a space proximate the load, wherein the load is further configured to send the refrigerant into the chamber between the exterior housing and the tube;
- a second load configured to use the refrigerant from the flash tank to remove heat from a second space proximate the second load;
- a compressor configured to:
  - receive the refrigerant from the chamber between the exterior housing and the tube; and
  - compress the refrigerant;
- an accumulator; and
- a second compressor, the second load is further configured to send the refrigerant to the second compressor through the accumulator.

2. The cooling system of claim 1, wherein:
- the second load is further configured to send the refrigerant to a second compressor;
- the compressor is further configured to send the refrigerant to the second compressor; and
- the second compressor is further configured to send the refrigerant to the high side heat exchanger.

3. The cooling system of claim 1, wherein the compressor is further configured to send the refrigerant to the second compressor through the accumulator.

4. The cooling system of claim 1, wherein the vessel further comprises a plurality of tubes positioned within the chamber, each tube of the plurality of tubes configured to remove heat from the refrigerant from the flash tank.

5. The cooling system of system of claim 1, wherein a liquid refrigerant precipitates by gravity at the bottom of the chamber.

6. A method comprising:
- removing heat from a refrigerant using a high side heat exchanger;
- storing the refrigerant using a flash tank;
- sending the refrigerant from the flash tank to a tube of a vessel, the vessel comprising a chamber defined by an exterior housing, the tube positioned within the chamber, wherein heat is removed from the refrigerant from the flash tank and in the tube;
- using the refrigerant to remove heat from a space proximate a load;
- using the refrigerant from the flash tank to remove heat from a second space proximate a second load;
- sending the refrigerant from the load into the chamber between the exterior housing and the tube;
- sending the refrigerant from the chamber between the exterior housing and the tube to a compressor, the compressor configured to compress the refrigerant; and
- sending the refrigerant from the second load to the second compressor through an accumulator.

7. The method of claim 6, further comprising:
- sending the refrigerant from the second load to a second compressor;
- sending the refrigerant from the compressor to the second compressor; and
- sending the refrigerant from the second compressor to the high side heat exchanger.

8. The method of claim 6, further comprising sending the refrigerant from the compressor to the second compressor through the accumulator.

9. The method of claim 6, wherein the vessel further comprises a plurality of tubes positioned within the chamber, each tube of the plurality of tubes configured to remove heat from the refrigerant from the flash tank.

10. The method of system of claim 6, wherein a liquid refrigerant precipitates by gravity at the bottom of the chamber.

11. A cooling system comprising:
- a vessel comprising:
  - a chamber defined by an exterior housing; and
  - a tube positioned within the chamber, wherein heat is removed from a refrigerant in the tube;
- a load configured to use the refrigerant from the tube to remove heat from a space proximate the load, wherein the load is further configured to send the refrigerant into the chamber between the exterior housing and the tube;

a second load configured to use the refrigerant from the flash tank to remove heat from a second space proximate the second load;

a compressor configured to:

receive the refrigerant from the chamber between the exterior housing and the tube; and compress the refrigerant;

an accumulator; and a second compressor, the second load is further configured to send the refrigerant to the second compressor through the accumulator.

12. The cooling system of claim 11, wherein:

the second load is further configured to send the refrigerant to a second compressor;

the compressor is further configured to send the refrigerant to the second compressor; and the second compressor is further configured to send the refrigerant to a high side heat exchanger.

13. The cooling system of claim 11, wherein the compressor is further configured to send the refrigerant to the second compressor through the accumulator.

14. The cooling system of claim 11, wherein the vessel further comprises a plurality of tubes positioned within the chamber, each tube of the plurality of tubes configured to remove heat from the refrigerant from the flash tank.

15. The cooling system of system of claim 11, wherein a liquid refrigerant precipitates by gravity at the bottom of the chamber.

* * * * *